US005549251A

United States Patent [19]

Provost

[11] Patent Number: 5,549,251

[45] Date of Patent: Aug. 27, 1996

[54] PULVERIZER THROAT ASSEMBLY

[76] Inventor: Robert S. Provost, 5630 Foxcross Pl., Stuart, Fla. 34997

[21] Appl. No.: 379,878

[22] Filed: Jan. 27, 1995

[51] Int. Cl.[6] ..... B02C 15/06

[52] U.S. Cl. ..... 241/119; 29/401.1

[58] Field of Search ..... 241/57, 119, 61, 241/116, 121; 29/401.1

[56] References Cited

U.S. PATENT DOCUMENTS

| | | | |
|---|---|---|---|
| 4,721,258 | 1/1988 | Dougan | 241/57 |
| 4,907,751 | 3/1990 | Wark et al. | 241/119 |
| 5,054,697 | 10/1991 | Provost | 241/61 |
| 5,340,041 | 8/1994 | Henning et al. | 241/119 |

FOREIGN PATENT DOCUMENTS

| | | | |
|---|---|---|---|
| 587989 | 1/1978 | U.S.S.R. | 241/119 |

*Primary Examiner*—Mark Rosenbaum
*Attorney, Agent, or Firm*—William L. Krayer

[57] ABSTRACT

A kit of segments is provided for replacing the throat of a coal pulverizer. The segments are so constructed that they may be assembled as either a rotatable throat or a stationary throat, and easily converted in place from one mode to the other. In the rotatable mode, the ledge covers over the throat segments are rotated with the throat.

7 Claims, 4 Drawing Sheets

PULVERIZER THROAT ASSEMBLY

TECHNICAL FIELD

This invention relates pulverizers such as large industrial pulverizers used to pulverize coal for burning in boilers for electrical generators. It is specifically directed to versatile and convenient replacements for throat assemblies in such pulverizers, to overcome the disadvantages of existing designs, which are cumbersome to replace and lead to excessive and erratic wear and poor distribution of the ground material.

BACKGROUND OF THE INVENTION

An industrial pulverizer which is more or less a forerunner of the type for which the present invention is an improvement is described in U.S. Pat. No. 4,264,041 to Kitto and Kowalski. This patent cites four earlier patents—2,275,595, 2,378,681, 2,473,514, and 2,545,254, all relating particularly to the configuration of the throat of the pulverizer. The '041 patent to Kitto and Kowalski itself is directed to improvements in the throat design. It is clear that throat design is of very high importance in the pulverizer art. The throat is the part of the pulverizer which is responsible for ejecting the pulverized coal from the grinding area into a forced air conveyor which will conduct it to a combustion zone.

In U.S. Pat. No. 4,874,135, Provost introduced the concept of a throat ring with specially designed air channels to ensure that the powdered coal is thrust centrifugally as well as upwardly towards the main stream headed to the combustion zone. Thereafter Provost described a wear ring for use with the throat ring, to further minimize wear. The fact that the entire throat ring and wear ring were removable was emphasized in this patent. They were designed so that they could be placed in existing pulverizers with a minimum of labor.

Rotating throats were introduced to the art a few years after the above mentioned Kitto and Kowalski '041 patent. See U.S. Pat. Nos. 4,687,145, 4,721,258, and 4,907,751. Rotating throats were directed to the same problems that faced the art in previous years—primarily, excessive or uneven erosion of various surfaces in the pulverizer, and imperfect distribution of the ground coal or other material. The art is also concerned with minimizing the consumption of power used for the forced air flow, and the unwanted accumulation of coal powder in areas under possibly incendiary or even explosive conditions.

A recent U.S. Pat. No. to Henning et al, 5,340,041, illustrates the continuing practice of maintaining the ledge cover as a fixture on the pulverizer housing when a rotating throat is used.

Replacing a stationary throat with a rotating throat and/or a rotating vane wheel in an existing more or less conventional pulverizer is an expensive and laborious process. The most difficult problem is that the stationary lower throat casting must be destroyed by dismembering it, typically with a plasma torch or by air-arcing. One is then thoroughly committed economically to a rotating throat; any thought of returning to a stationary throat will find the cost prohibitive. The grinding table or yoke must also be tediously machined in place to accommodate attaching the rotating throat segments. Because of the cramped quarters, accuracy of the machining cannot be guaranteed or even, perhaps, expected.

A primary objective of the present invention is therefore to provide a rotatable throat which can be relatively easily put in service on existing pulverizers, but which can also serve as a stationary throat if so desired. At the same time, the design answers the other needs of the art respecting "dribble" of the larger particles, uneven wear of various surfaces in the machine, and optimum power consumption in the air turbine.

While my invention is not limited to application in the Babcock & Wilcox MPS-89 pulverizer, it will be described with particular reference to this machine because it typifies the pulverizers in wide use in the United States and elsewhere, and the design is typical of the pulverizers in which my invention will find use. The B&W MPS-89 employs a rotating grinding table with wear-resistant cast iron track ring and three stationary wheels and tires to pulverize coal for combustion in utility boilers. A good description of this machine may be found on page 9–7 of "Steam"a book published by Babcock & Wilcox Company, copyrighted in 1978; the description is incorporated herein by reference. The wheels and tires are loaded by means of springs compressed by tensioning rods. Hot, temperature-controlled primary combustion air is introduced into an annular space in the pulverizer below the grinding table, and is distributed around the periphery of the grinding table through air ports. The peripheral area including the ports is the throat.

Primary air performs four functions in the pulverizer: drying of the coal in the pulverizer, maintaining a fluidized bed of coal, which circulates coal into the path of the grinding elements, transporting the pulverized coal particles from the fluidized bed into the classifier assembly, where large particles are separated for return to the grinding elements, and transporting suitably-pulverized coal particles out of the classifier to the burners.

The air ports in the pulverizer throat are configured to agitate the fluidized bed vigorously, thereby enhancing the drying action, to redirect and move the fluidized bed of coal back into the path of the grinding elements, and to establish a swirl inside the pulverizer that enhances the cyclonic separation of heavier particles of coal in the classifier.

The throat assembly of the B&W MPS-89 is made up of a stationary lower ring, replaceable upper ring segments, and ledge cover segments which are invariably stationary, fixed to the inside of the pulverizer housing, all arranged desirably to minimize turbulence, which tends to accelerate wear from the abrasive particles. Often, restrictor bars must be welded into the throat openings to adjust the amount of primary air flowing through the ports. Without proper aerodynamics, the restrictor bars aggravate the unwanted turbulence, and accelerate wear of the upper throat segments. Often, there is a mis-match between upper and lower segment ports which traps rejects in the port, leading to clogging of the ports, particularly in areas of low air flow.

As originally designed, the throat assembly is stationary, with an air seal between the rotating grinding table and the throat to minimize air leakage. A stationary throat allows varying pressure differentials (with corresponding variable air flows) along the circumference of the grind ring, which further upsets the proper aerodynamics of the fluidized bed, causes accelerated wear in some areas of the pulverizer, and results in less than optimum performance of the pulverizer with respect to coal fineness at the burner pipes. A number of rotating throat designs have been offered to correct some or all of the problems associated with stationary throats, but replacement of the original throat with any of the rotating style throats widely offered is very costly, labor intensive, and leaves no other options.

SUMMARY OF THE INVENTION

My invention is a universal kit for the installation of a throat of a new design into a pulverizer, based on a new concept which is the fact that the entire throat assembly, including the ledge covers, is designed to be attached to and rotate with the grinding table, at the same time being versatile enough to be easily converted, if desired, into a stationary throat mounted on the shell of the pulverizer.

In either configuration of my invention (right or left handed) an air seal is provided at the upper and lower ends of the throat. Clearances are maintained between the rotating throat and the casing support ring and between the notched ledge cover and the ceramic liner in the pulverizer. As a stationary throat, clearances are maintained between the air seal ring and the locator ring attached to the yoke.

DETAILED DESCRIPTION OF THE INVENTION

Figure 1:
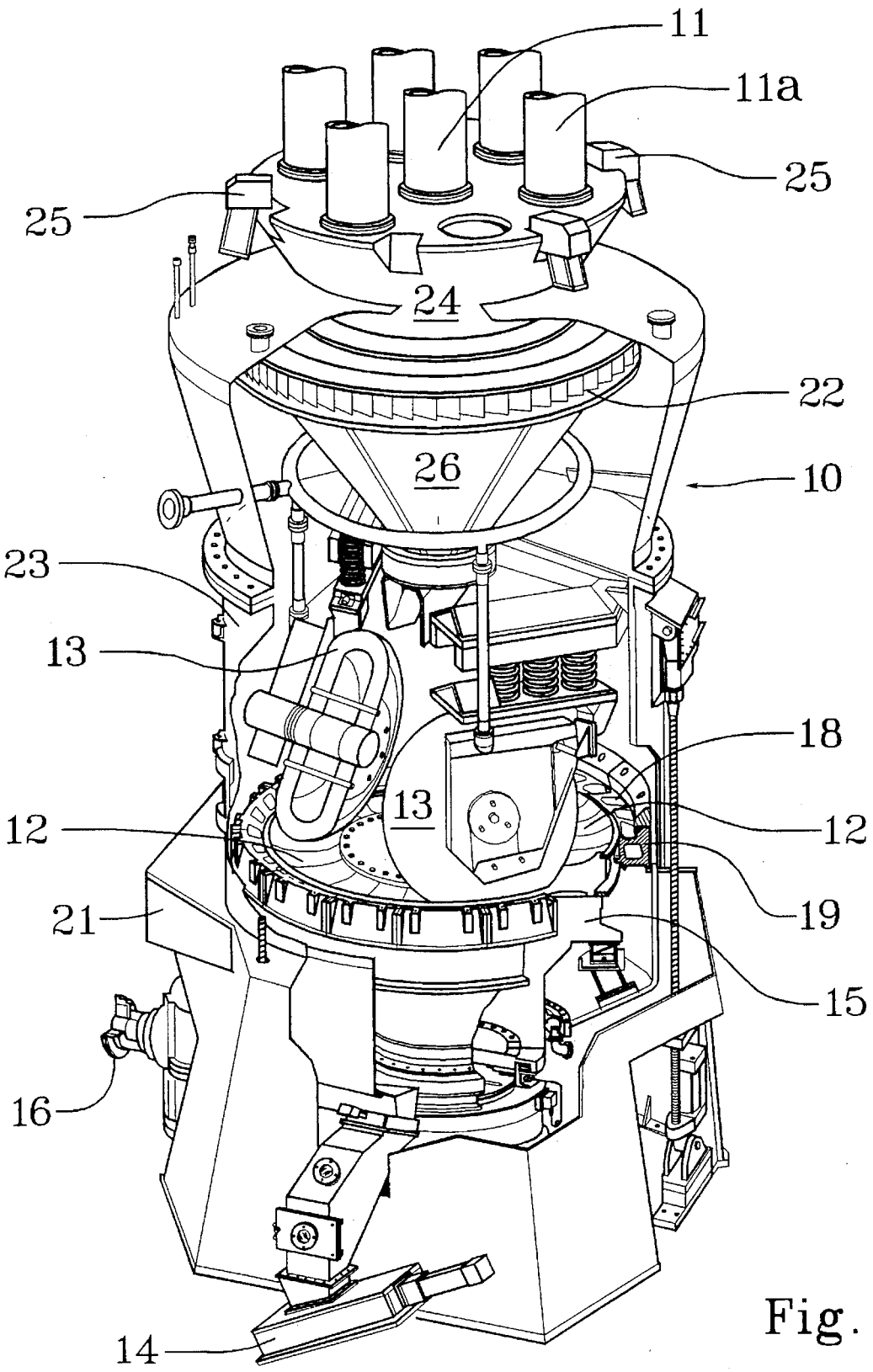
Fig. 1 PRIOR ART
FIG. 1 is an elevational view of a prior art coal pulverizer with parts broken away so as to show the functional relationship and operation of the various elements of the mill.

Referring now to FIG. 1, the entire figure is an elevational view of a coal pulverizer 10, with parts broken away. Raw coal is fed into the top of the pulverizer through raw-coal pipe 11 and descends in known manner to and upon trough-shaped grinding ring 12 which forms a revolving circular trough in which revolve grinding wheels 13. A "pyrites box" 14 receives mineral particles separated from the ground coal.

The grinding ring 12 having a base or yoke 15 is driven by conventional drive mechanism not shown and motor shaft 16. The grinding ring 12 revolves at high speeds and causes the spring-weighted grinding wheels to revolve in place and at high speed in the trough-shaped ring 12 and to crush the coal lying thereon. The pulverized coal is centrifugally thrust by the rapid revolution of the grinding ring 12 at a rate for example between about 1500 and 3000 pounds per minute across the air channels 18 of the throat ring 19 which circumscribes the grinding ring 12. The throat ring 19 concentrically surrounds the coal grinding assembly such that all of the pulverized coal passes over the throat ring.

Forced air is supplied through air inlet 21 to and through the air channels 18 of the throat ring 19 at a rate of flow to create maximum air/coal flow of between 1500 and 3000 pounds per minute. The forced air imparts to the coal a swirling motion and carries the coal upward to the classifier louvre sections 22. The housing 23 of the pulverizer is protected from the abrasive action of the swirling coal particles by a ceramic tile lining, not shown. The coal-air mixture flows from the classifier louvre sections 22 to discharge turret 24, which comprises the central raw coal feeder pipe 11 and a plurality of burner pipe valves 25 which provide access to the burner pipes 11*a* leading to a combustion zone usually of a boiler or boilers of an electric power plant. Large coal particles fall from the classifier assembly into classifier cone 26 from which they are discharged in known manner to the coal grinding assembly.

It should be noted that, in the original prior art pulverizer design, the throat ring 19 is referred to as fixed, or stationary; that is, it is not of a type which can rotate with grinding ring 12 and/or yoke 15; rather, yoke 15 and grinding ring 12 rotate concentrically within the throat ring 19. Such stationary throat rings are typically mounted directly on the inner wall of housing 23 of the pulverizer, but may be independently supported.

As mentioned previously, prior art throat rings have been made to rotate, typically by installing vanes and/or air ports directly on a grinding table or yoke such as yoke 15, but even the so-called rotatable throats include an outer surface which is anchored to the inside of the pulverizer housing or wall. This creates a "pinch point" which is readily accessible to stray pieces of coal, causing numerous problems and erratic behavior of the pulverizer.

As will be seen in the discussion below, my configuration differs from prior art designs in that, when it is installed in the rotatable mode, the ledge covers as well as the throat segments rotate with the grinding ring; thus the entire assembly is free of the pulverizer housing.

Figure 2A:
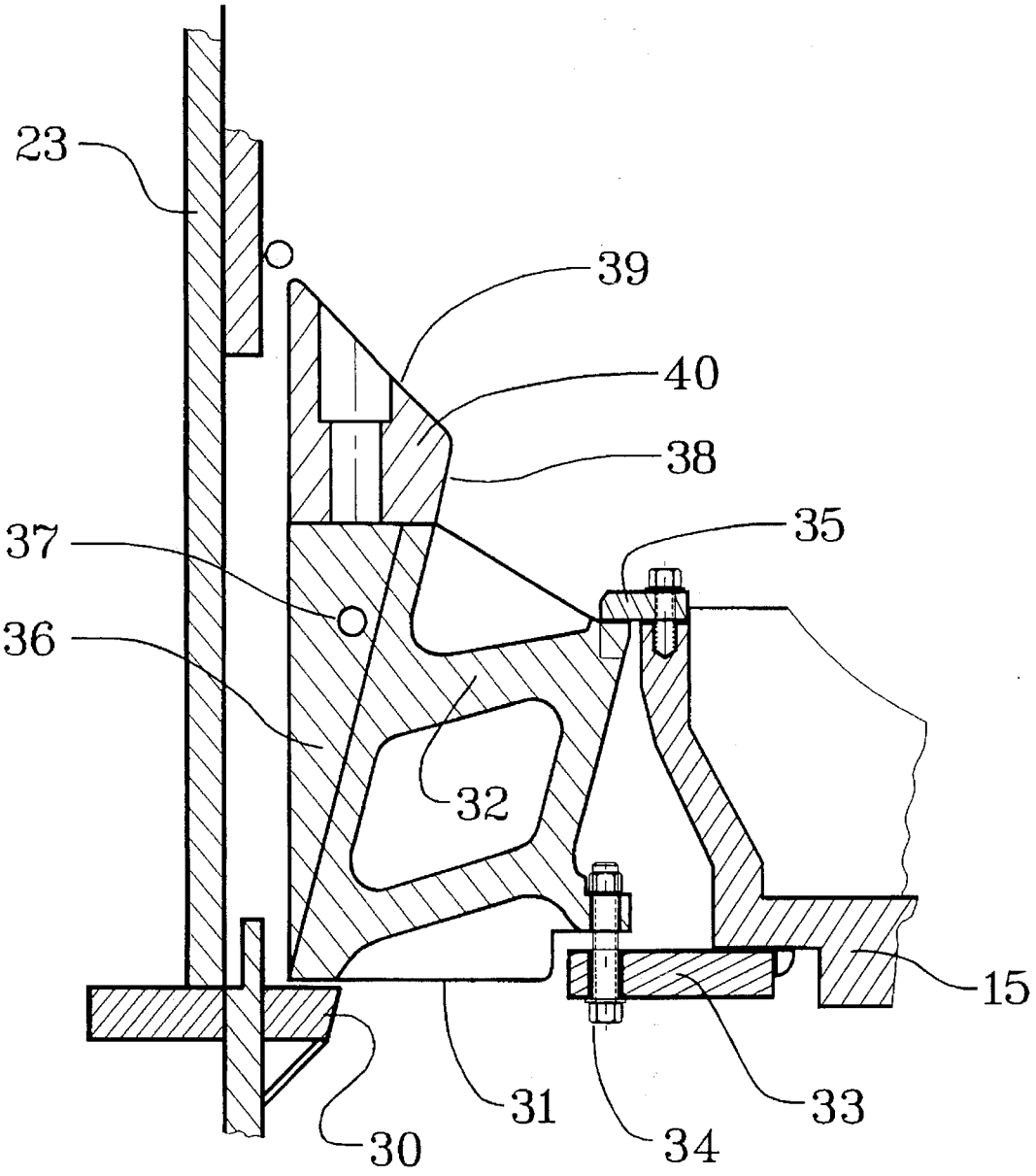
FIG. 2*a* is a side sectional view of a segment of my invention mounted so as to be rotatable with the yoke or grinding table of the pulverizer.

FIG. 2*a* shows in section the rotatable configuration of my invention, wherein the housing 23 does not support any of the material parts. Casing support ring 30 is illustrated because it is typically already present in the pulverizer to be retrofitted with our invention. Although the casing support ring 30 performs no support function in my invention, I prefer to align the bottom surface 31 of throat segments 32 about three eighths inch above the casing support ring 30. The throat segments 32 are attached to yoke 15 by means of a mounting ring 33 which encircles yoke 15 and is welded to it. Bolts 34 also serve to fasten throat segments 32 to mounting ring 33. The air seal ring 35, like the casing support ring 30, may be present already in the pulverizer to be retrofitted with my invention. Air seal ring 35 encircles the upper extremity of yoke 15 to minimize air leakage. A flange 36 on the throat segment 32 is provided with a predrilled hole 37 for fastening the throat segments 32 together tangentially. The inwardly directed lower surface 38 and the outwardly directed upper surface 39 of ledge cover 40 are more or less as configured in the prior art with the major exception that ledge cover 40 is not fastened to housing 23 but rather rotates with the throat segments 32.

Figure 2B:
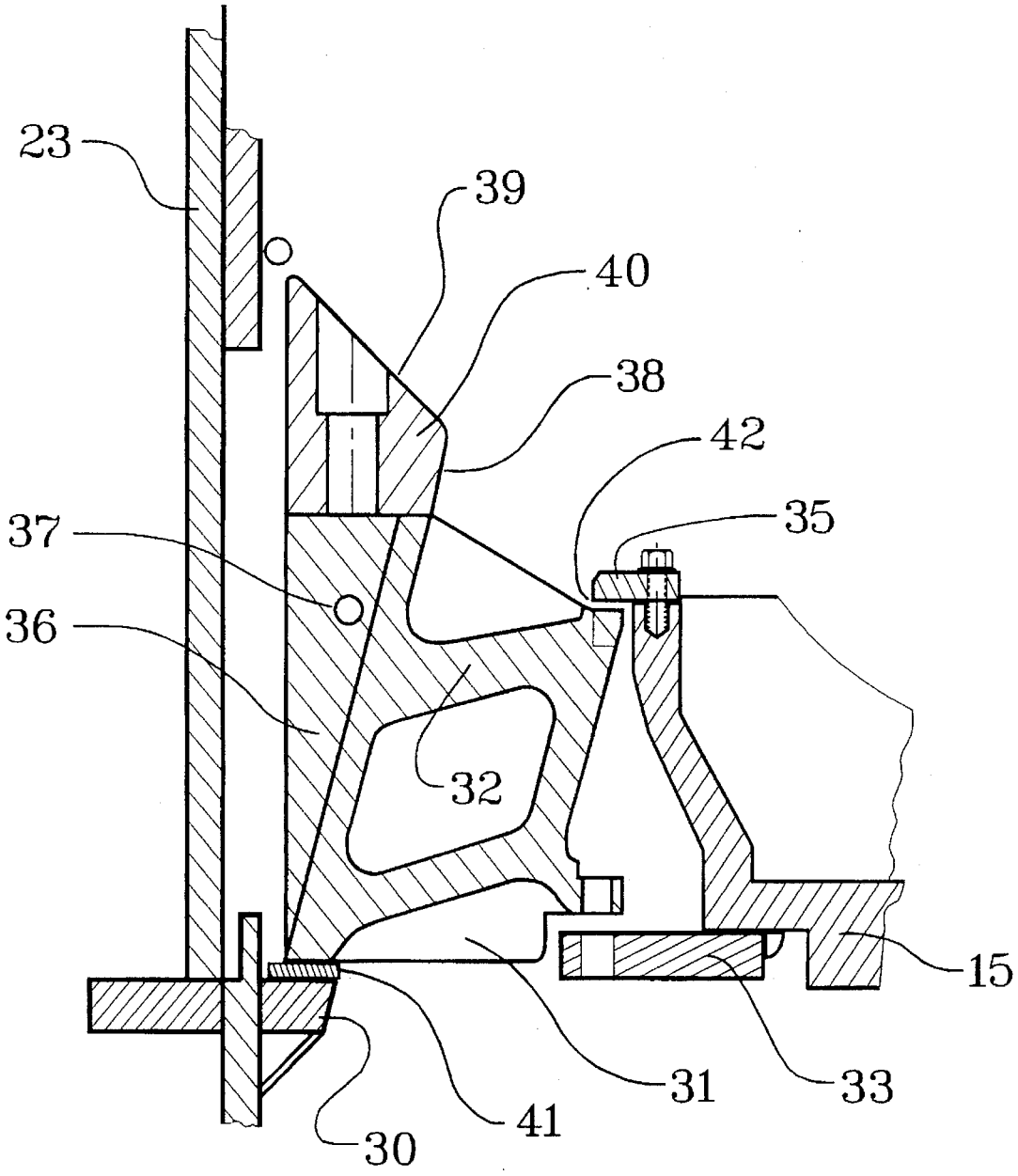
FIG. 2*b* is a side sectional view similar to FIG. 2*a* except that the throat has been fixed to the inside of the shell of the pulverizer; the throat thus does not rotate but appropriate clearance is provided for rotation of the yoke and grinding table.

As indicated in FIG. 2*b*, this rotatable configuration is easily converted to a stationary configuration by means of shim 41 placed in the space between bottom surface 31 of the throat segments 32 and the casing support ring 30. In this case the bolts 34 (see FIG. 2*a*) are removed, and segments 32 are lowered slightly to rest on shims 41, thus creating a space 42 below air seal ring 35. Yoke 15 and mounting ring 33 are thus free to rotate without contacting throat segment 32.

Figure 3:
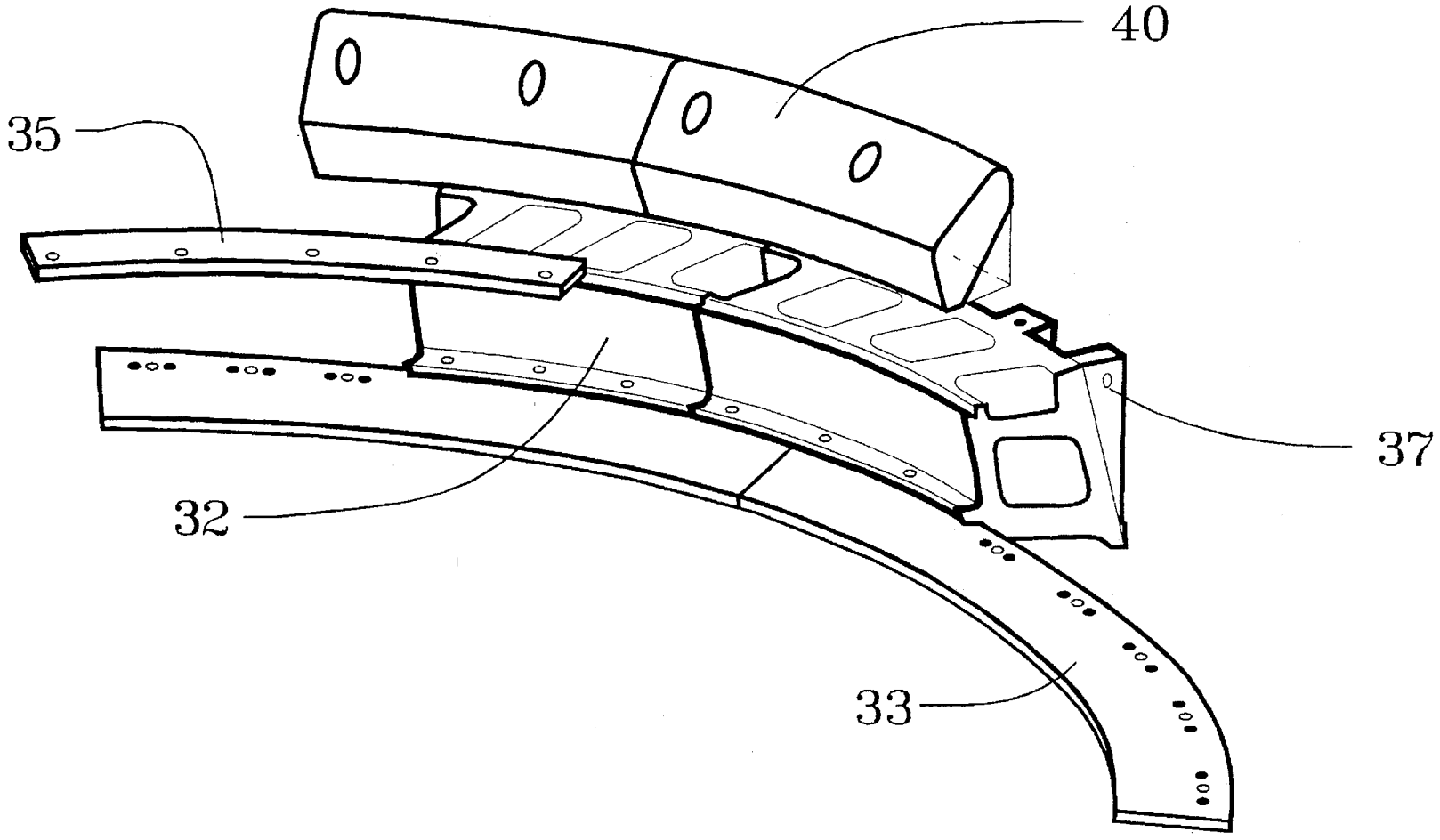
FIG. 3 is a vertically exploded view of the juxtaposition of a portion of the mounting ring segments, throat segments, and ledge covers of my invention.

In FIG. 3, a portion of the assembly has been exploded vertically to show the mounting ring 33 segments, the throat ring segments 32 including predrilled holes 37, and the ledge covers 40. The exact number of each such segment is not crucial, but I prefer to employ six mounting ring segments 33, fourteen throat segments 32 partially covered by segments of the air seal ring 35, and fourteen ledge cover segments 40 which are staggered with respect to the throat segments 32 so the seams between them are not vertically aligned.

My invention includes a kit of the mounting rings, throat segments, and ledge covers, together with shims, which can be assembled into a stationary configuration as described, as well as the rotatable one shown in FIG. 2*a*.

I claim:

1. In a coal pulverizer having a rotatable grinding table and a pulverizer throat, an improved pulverizer throat comprising a mounting ring, a throat ring mounted thereon, and a ledge cover ring mounted on said throat ring, all of said mounting ring, throat ring and ledge cover ring being attached to and rotatable with said grinding table.

2. A pulverizer throat of claim 1 wherein said throat ring, said wear ring, and said ledge cover ring are radially segmented.

3. Method of converting a coal pulverizer having a grinding table and an initially stationary throat attached to the internal wall of said pulverizer to a coal pulverizer having a rotatable throat which can be readily reconverted to a stationary throat, comprising removing said initially stationary throat and assembling a plurality of mounting ring segments to form a mounting ring, attaching said mounting ring to said grinding table, assembling a plurality of throat segments to form a throat ring on said mounting ring, and assembling a plurality of ledge cover segments to form a ledge cover on said throat ring, thereby forming a rotatable throat which includes said ledge cover segments.

4. Method of claim 3 including fastening said throat segments together.

5. Method of converting a coal pulverizer having a housing including a casing support ring, a grinding table including a yoke, and a throat which is either stationary or rotatable to a coal pulverizer having a stationary throat which can readily be converted to a rotating throat, comprising (a) removing said throat and assembling a plurality of mounting ring segments to form a mounting ring, (b) attaching said mounting ring to said grinding table and said yoke, (c) assembling a plurality of throat ring segments to form a throat ring supported by said casing support ring, and (d) adjusting the height of said throat ring segments to render said throat ring segments free of said mounting ring and said yoke so said mounting ring and said yoke may rotate free of said throat ring segments by inserting shims between said throat ring segments and said casing support ring.

6. Method of claim 5 including fastening said throat ring segments together.

7. Method of claim 5 including the step of assembling a plurality of ledge cover segments to form a ledge cover on said throat ring.

* * * * *